US008720241B1

(12) United States Patent
Widén

(10) Patent No.: US 8,720,241 B1
(45) Date of Patent: May 13, 2014

(54) CYLINDER LOCK AND KEY WITH SIDE BAR

(71) Applicant: Winloc AG, Zug (CH)

(72) Inventor: Bo Widén, Torshälla (SE)

(73) Assignee: Winloc AG, Zug (CH)

( * ) Notice: Subject to any disclaimer, the term of this patent is extended or adjusted under 35 U.S.C. 154(b) by 0 days.

(21) Appl. No.: 13/899,973

(22) Filed: May 22, 2013

(51) Int. Cl.
*E05B 27/00* (2006.01)

(52) U.S. Cl.
USPC ..... 70/495; 70/409; 70/419; 70/494

(58) Field of Classification Search
USPC ..... 70/378, 494, 495, 409, 419
See application file for complete search history.

(56) References Cited

U.S. PATENT DOCUMENTS

| | | | | | |
|---|---|---|---|---|---|
| 2,194,469 | A | * | 3/1940 | Fremon | 70/493 |
| 3,002,268 | A | * | 10/1961 | Spain | 29/436 |
| 3,080,744 | A | * | 3/1963 | Spain | 70/495 |
| 3,455,130 | A | * | 7/1969 | Basseches | 70/421 |
| 3,499,302 | A | | 3/1970 | Spain et al. | |
| 3,499,303 | A | * | 3/1970 | Spain | 70/494 |
| 3,507,133 | A | * | 4/1970 | Basseches | 70/421 |
| 3,722,240 | A | | 3/1973 | Spain et al. | |
| 3,985,010 | A | * | 10/1976 | Idoni | 70/494 |
| 4,235,086 | A | * | 11/1980 | Genakis | 70/494 |
| 4,356,713 | A | * | 11/1982 | Widen | 70/495 |
| 4,409,807 | A | * | 10/1983 | Lipschutz | 70/340 |
| 4,635,455 | A | | 1/1987 | Oliver | |
| 4,723,427 | A | | 2/1988 | Oliver | |
| 4,732,022 | A | | 3/1988 | Oliver | |
| 4,756,177 | A | * | 7/1988 | Widen | 70/493 |
| 4,815,307 | A | * | 3/1989 | Widen | 70/493 |
| 4,998,426 | A | * | 3/1991 | Genakis | 70/494 |
| 5,209,087 | A | * | 5/1993 | Cox | 70/369 |
| 5,375,444 | A | * | 12/1994 | Smith | 70/495 |
| 5,454,246 | A | * | 10/1995 | Mueller | 70/495 |
| 5,640,865 | A | * | 6/1997 | Widen | 70/495 |
| 5,956,984 | A | * | 9/1999 | Hughes | 70/394 |
| 6,301,942 | B1 | * | 10/2001 | Shvarts | 70/367 |
| 6,481,255 | B2 | * | 11/2002 | Theriault et al. | 70/495 |
| 6,981,396 | B1 | * | 1/2006 | Kim | 70/495 |
| 7,370,502 | B2 | * | 5/2008 | Widen | 70/493 |
| 7,775,074 | B1 | * | 8/2010 | Tobias et al. | 70/493 |
| 7,958,760 | B2 | * | 6/2011 | Widen | 70/378 |
| 7,963,135 | B1 | * | 6/2011 | Tobias et al. | 70/493 |
| 8,061,168 | B2 | * | 11/2011 | Widen | 70/409 |
| 8,210,009 | B2 | * | 7/2012 | Widen | 70/409 |
| 8,266,937 | B2 | * | 9/2012 | Lienau et al. | 70/409 |
| 8,302,439 | B1 | * | 11/2012 | Tobias et al. | 70/394 |
| 8,448,485 | B1 | * | 5/2013 | Widen | 70/494 |
| 2012/0073340 | A1 | * | 3/2012 | Widen | 70/495 |

* cited by examiner

*Primary Examiner* — Suzanne Barrett
(74) *Attorney, Agent, or Firm* — Birch, Stewart, Kolasch & Birch, LLP

(57) ABSTRACT

A cylinder lock and key combination includes a cylinder lock with a housing accommodating a rotatable key plug having a keyway. A row of tumbler pins are arranged in corresponding cylindrical chambers for engagement with coded V-cut bittings of an associated key. A longitudinal side bar with a row of inner projecting lugs each selectively registering with one or more recesses in the tumbler pins is slidingly journalled for transversal movement in the key plug. The coded V-cut bittings are at a respective angle and are located at a respective vertical level. The row of inner projecting lugs of the side bar is located above the top bitting level of the key blade. The tumbler pins are positioned in pin recesses located in a cylindrical outer surface and covered by a cylindrical wall part of an associated one of said cylindrical chambers, without communicating downwardly with the keyway.

27 Claims, 11 Drawing Sheets

Fig 6
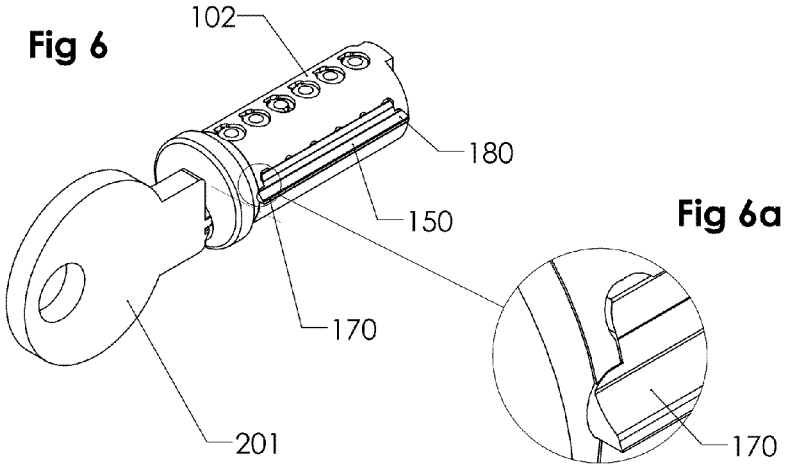
Fig 6a
Fig 7a
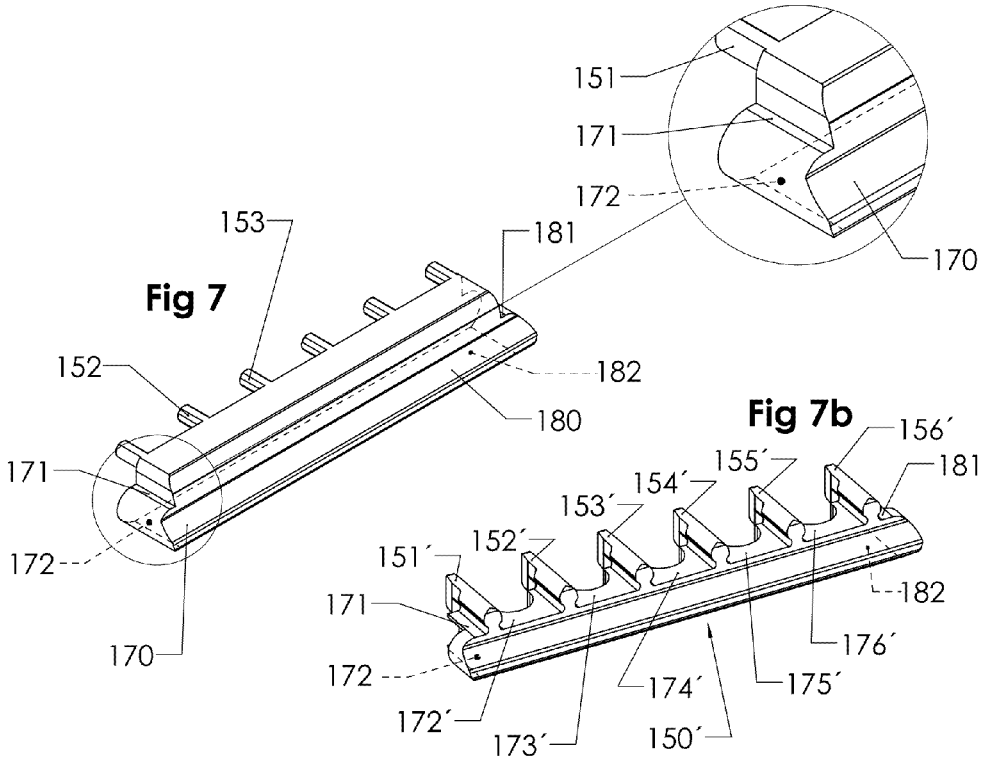
Fig 7
Fig 7b

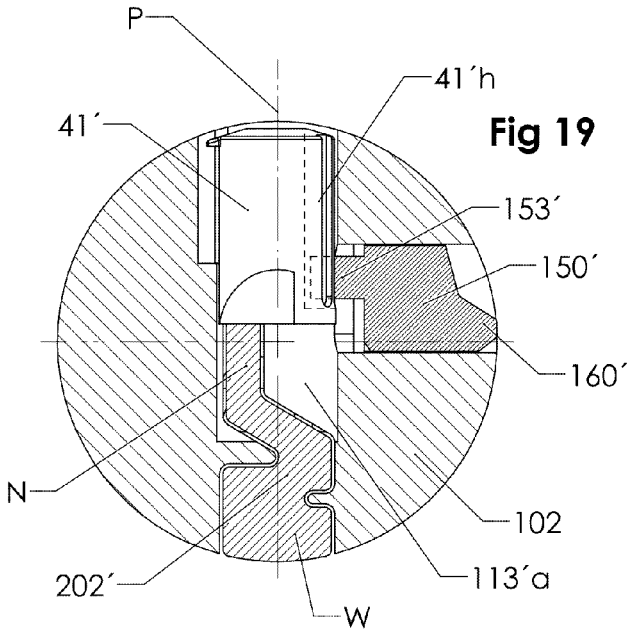
Fig 19
Fig 20
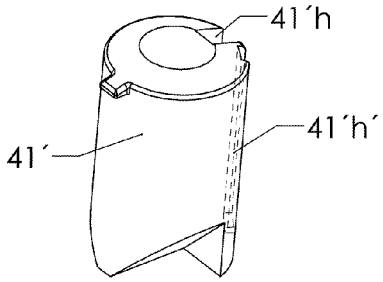
Fig 20a
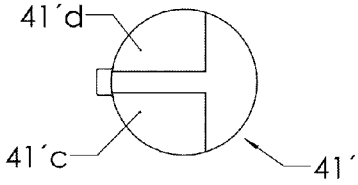
Fig 20b
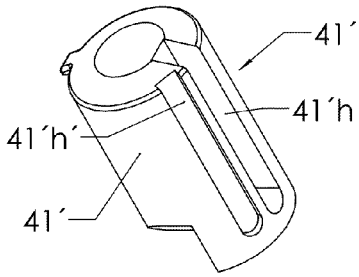
Fig 20c
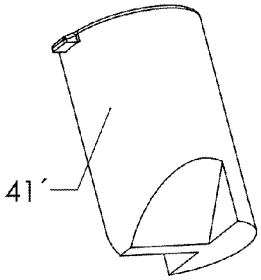
Fig 20d
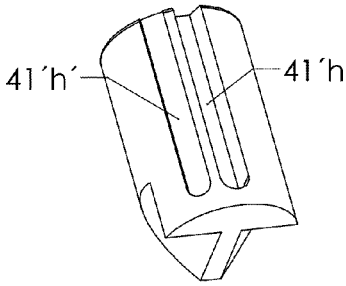

CYLINDER LOCK AND KEY WITH SIDE BAR

FIELD OF THE INVENTION

The present invention relates to a cylinder lock and key combination, including a cylinder lock, comprising a housing having a cylindrical bore accommodating a rotatable key plug, said key plug having a longitudinally extending keyway for receiving a key blade, a row of tumbler pins arranged for elevational and rotational movement in corresponding cylindrical chambers in said key plug for engagement with coded V-cut bittings on an upper edge of an associated key upon insertion thereof into said keyway, and a longitudinal side bar which is slidingly journalled for transversal movement in said key plug, said side bar having an outer, longitudinal ridge portion fitting into an associated groove in said housing, so as to normally prevent rotation of said key plug in said cylindrical bore of the housing, said side bar also having a row of inner projecting lugs each selectively registering with one or more recesses in said tumbler pins when said key has been inserted into said keyway, said side bar being movable sideways by turning of a correctly cut key, while said projecting lugs enter into said associated tumbler pin recesses so that said longitudinal ridge portion is released from said groove and the key plug is permitted to rotate relative to said housing, and a key, comprising said key blade having an upper edge provided with said coded V-cut bittings each standing at a respective one of a first number of angles relative to a transverse direction and being located at a respective one of a second number of vertical levels in relation to an opposite lower edge of the key blade, a top bitting level being located above the rotary axis of said key plug upon being inserted into the keyway.

BACKGROUND OF THE INVENTION AND PRIOR ART

Cylinder lock and key combinations of this kind are previously known, e.g. from the U.S. Pat. Nos. 3,722,240, 3,499,302, 4,635,455, 4,723,427 and 4,732,022 (all assigned to Medeco Security Locks, Inc.). They provide well functioning and secure mechanisms. Because of the dual lock feature (tumbler pins as well as a side bar locking mechanism), these locks are difficult to manipulate, in particular by picking and/or so called "bumping".

However, for certain geometrical configurations, it may be possible to inspect an empty lock (without any key in the keyway) and find out the codes relating to the rotational positions of the "gates" or slots which should register with projections on the side bar. If such inspection is successful, it may be less difficult to bypass or open the lock.

In particular, when the keyway is relatively high, to accommodate a key blade with a large height, such as a key blade extending above the rotational axis of the key plug, some of the tumbler pins may be exposed from the inside of the keyway, so that the "gates" or slots (or other recesses or holes) can be identified or sensed, and their relative locations may be determined.

OBJECT OF THE INVENTION

Against this background, a primary object of the present invention is to provide a cylinder lock and key combination, of the kind stated above, where the lower portions of the tumbler pins, even when these pins are located in their lowermost positions in an empty lock, do not reveal the locations of the recesses or "gates" that cooperate with the projections on the side bar.

Further objects are to ensure that the side bar slides back and forth without overdue resistance when the key is turned either way to operate the lock, and to provide a large variety of tumbler pins so as to increase the number of possible codes.

Another object is to increase the security of the lock even more as compared to prior art locks of this kind.

A still further object is to provide improved key profiles and key bittings.

SUMMARY OF THE INVENTION

These objects are achieved by a combination of features of the tumbler pins, the side bar and the key blade, as follows:

the row of inner projecting lugs of the side bar is located above the top bitting level of the key blade, preferably also above the uppermost part of the keyway, when these lugs are being moved sideways with the side bar into the respective tumbler pin recesses, and the tumbler pins are configured so that each of the pin recesses is located in a cylindrical outer surface of the tumbler pin and is covered by a cylindrical wall part of the associated cylindrical chamber in the key plug, without communicating downwardly with the keyway, whereby each pin recess is concealed and invisible from the inside of the keyway, even when the keyway is empty.

According to another aspect of the invention, the outer longitudinal ridge portion of the side bar is located at a lower vertical level, preferably at substantially the same vertical level as the rotary axis of the key plug, than the inner projecting lugs of the side bar, in relation to a central vertical plane in the keyway. Then, the side bar will have a thickness which is, in a vertical dimension parallel to said central vertical plane, about half of the radius of the cylindrical bore in the lock housing, or even larger. Even so, with such a relatively large thickness, it is possible to achieve a good sliding movement of the side bar, e.g., by providing each longitudinal end portion, or intermediate portions, of the side bar with transversally extending guiding surfaces which secure a precise lateral guiding of the side bar in the key plug. Preferably, these transversally extending guiding surfaces should be located opposite to each other at a mutual distance which is smaller than the overall thickness of the side bar.

According to another aspect of the invention, at least some of the tumbler pins should have pin recesses located at two or more different locations, so as to enable the forming of a master key system, e.g. in a similar manner as is previously known per se.

As will be explained further below, by providing extra recesses in the cylindrical outer surface of the tumbler pins, the security of the lock can be improved even further, as compared to prior art locks of this kind.

Furthermore, each of the tumbler pins may have a lower portion with two oppositely located, inclined planar surface portions (like a "chisel" configuration) forming between them a linear, relatively narrow guiding portion fitting into a corresponding V-cut code bitting in the associated key blade, each pin recess being located at a cylindrical outer surface portion at a distance from any of said inclined surface portions.

The invention also relates to an improved side bar, an improved key and an improved key blank.

There are a number of possible, advantageous geometrical configurations of the tumbler pins, as will be apparent from the appended claims and the detailed description below.

BRIEF DESCRIPTION OF THE DRAWINGS

The invention will now be further explained with reference to the appended drawings, in which

FIG. 6 shows a perspective view of the key plug (with inserted key) of the lock of FIGS. 1, 2, 3, and 5, the lock housing and the upper pins being taken away;

FIG. 6*a* shows, at a larger scale, a detail of FIG. 6;

FIG. 7 shows, in a perspective view, the side bar which is slidingly journalled in the key plug shown in FIG. 6;

FIG. 7*a* shows, at a larger scale, a detail of FIG. 7;

FIG. 7*b* shows, also in a perspective view, a modified side bar with intermediate guiding surfaces between each pair of adjacent lugs;

FIG. 19 shows a cross-section, corresponding to that of FIG. 18, of an embodiment where the upper part of the key blade is offset in relation a to a central plane of the tumbler pin and the keyway and where the tumbler pin is somewhat different from the previous embodiments;

FIG. 20 shows the tumbler pin included in the embodiment of FIG. 19, in a perspective view;

FIG. 20*a* shows the tumbler pin of FIG. 20, in a view from underneath; and FIGS. 20*b*, 20*c* and 20*d* show the tumbler pin of FIG. 20 in three different perspective views.

DETAILED DESCRIPTION OF PREFERRED EMBODIMENTS

Figure 1:
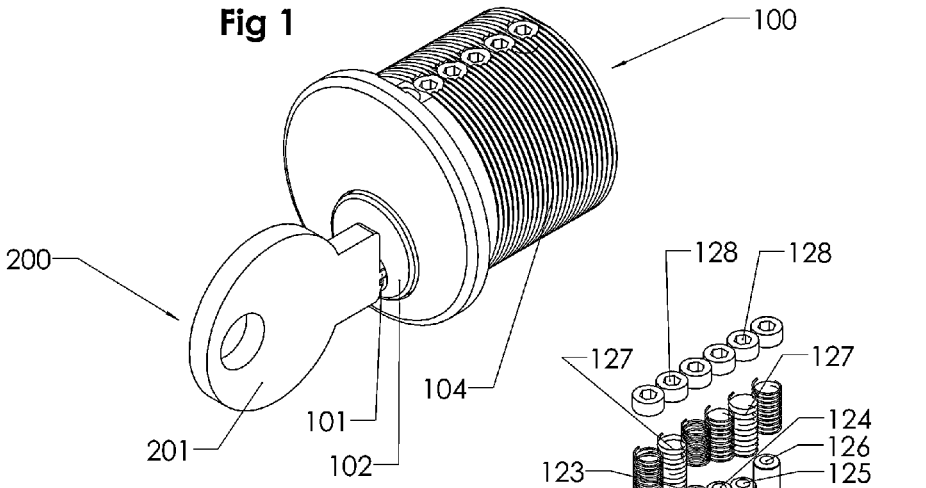
FIG. 1 illustrates, in a perspective view, a cylinder lock and key combination according to the invention.
Figure 2:
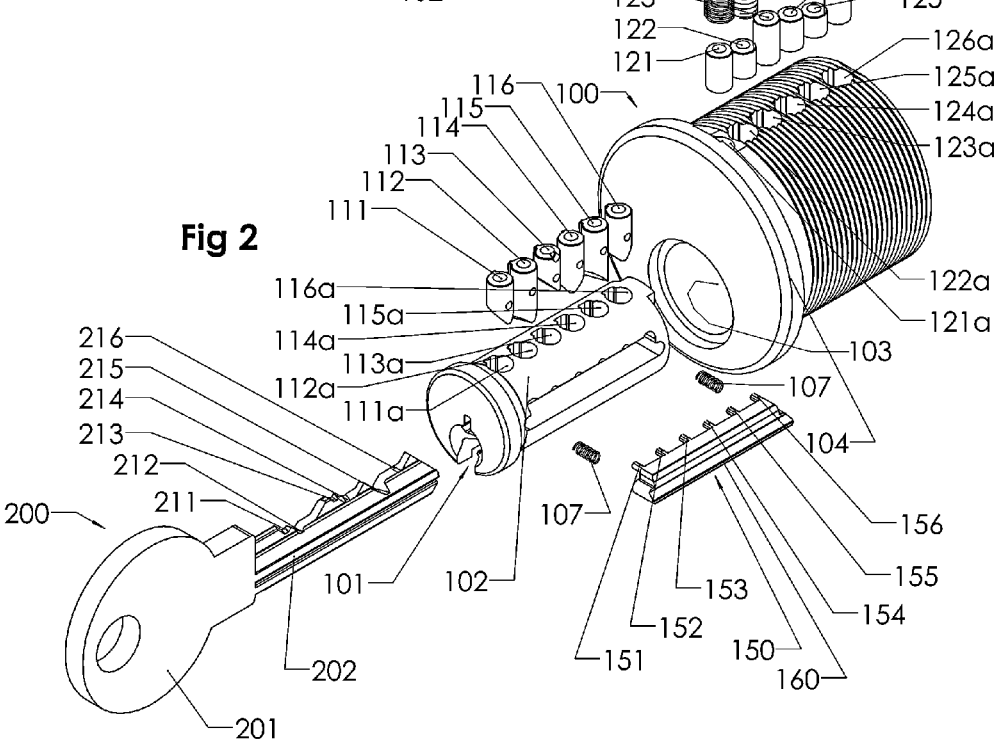
FIG. 2 shows an exploded, perspective view of the lock and key combination of FIG. 1, with the most important components being separated from each other.

The cylinder lock and key combination illustrated in FIGS. 1,2,3 and 5 includes a cylinder lock 100 and an associated key 200 with a grip 201 and a key blade 202. The key blade 202 can be inserted into a longitudinal keyway 101 in a cylindrical key plug 102, which is rotatable in a cylindrical bore 103 in a housing 104 of the lock 100.

The key plug 102 is normally held in a locked rotational position by way of two interacting lock mechanisms, comprising a set of cylindrical, lower tumbler pins 111, 112, 113, 114, 115, 116, which are fitted slidingly in vertically oriented cylindrical chambers 111*a*, 112*a*, 113*a*, 114*a*, 115*a*, 116*a* and which are aligned with a corresponding set of upper tumbler pins 121, 122, 123, 124, 125, 126 in associated cylindrical holes 121*a*, 122*a*, 123*a*, 124*a*, 125*a*, 126*a*, and a side bar 150 which is movable sideways and has a radially outer ridge portion 160 which is normally accommodated in a longitudinal groove 105 (see FIG. 5) in the lock housing 104 so as to prevent rotation or turning of the key plug 102 in relation to the housing 104.

Figure 5:
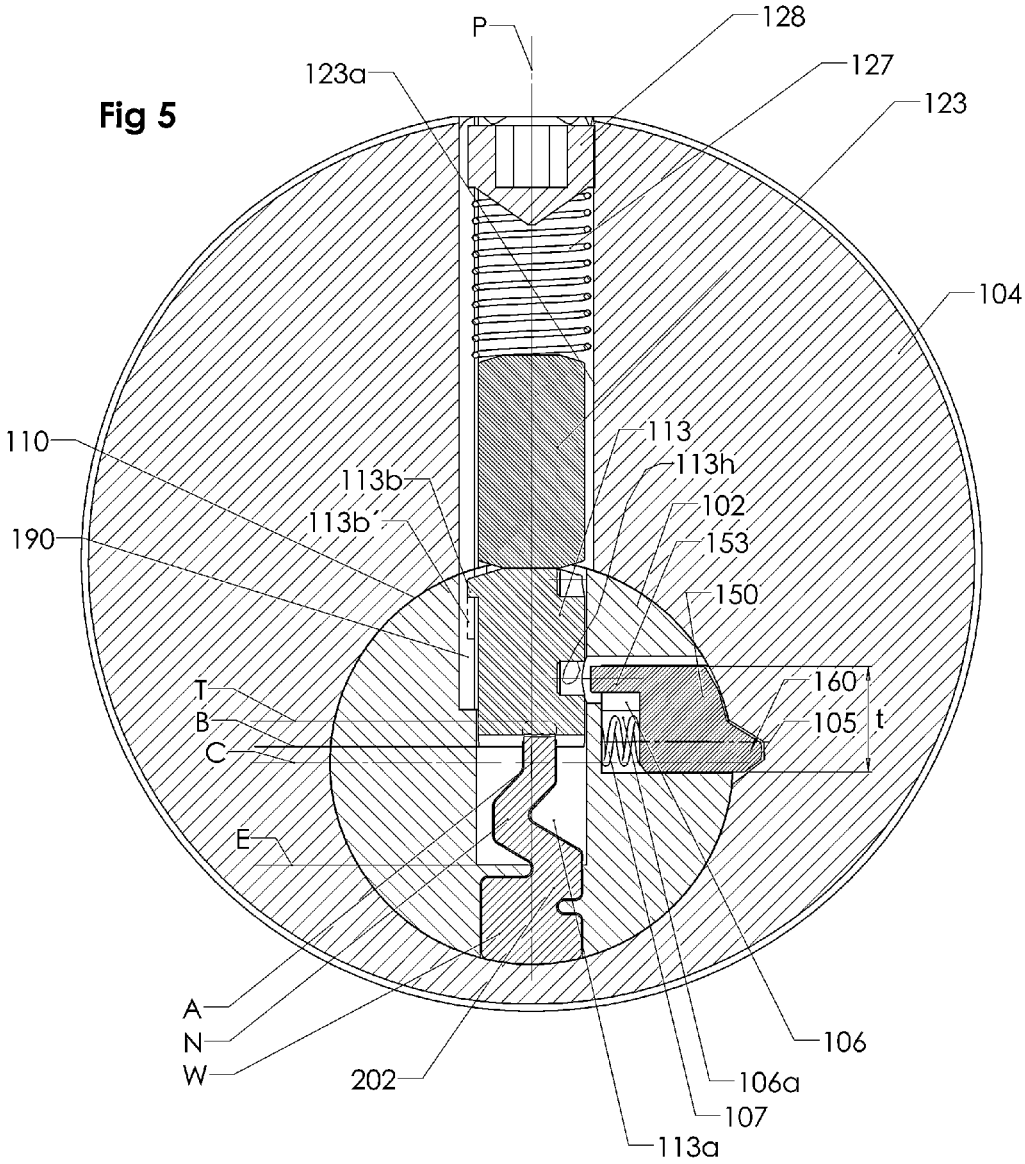
FIG. 5 shows a cross-section along the line V-V in FIG. 3, at a larger scale and illustrating the interacting components of the lock and key combination of the invention.

When the key plug is located in the rotational position shown in FIG. 5, the lower and upper pins 111-116 and 121-126 are pair-wise aligned with each other and are movable vertically along a vertical axis in a central vertical plane P through the housing 104.

In this specification, all references to "vertical", "upper" and "down", etc. are related to the vertical plane P in FIG. 5. It is understood, however, that this plane may be oriented differently in a particular embodiment of a lock and key combination according to the invention.

Each pair of upper and lower pins, such as the pins 113 and 123 visible in FIG. 5, are urged downwards by a set of helical springs 127 acting between the respective upper pin 121-126 and a top end closure member 128 secured at the upper end of the respective cylindrical chambers or holes 121*a*-126*a*.

When a correctly cut key blade 202 is fully inserted into the keyway 101, each pair of lower and upper tumbler pins 111 and 121, etc. will be positioned with their abutting upper and lower contact surfaces located at a shear line 110 (FIG. 5) between the rotatable key plug 102 and the stationary housing 104, so as to enable a turning motion of the key plug 102 in relation to the housing 104. When the key plug is turned, by means of the key blade 202 (operated with the grip 201), the outer ridge portion 160 will be forced to move sideways inwardly towards the keyway 101 and the central plane P of the housing 104, against the action of springs 107 (visible in FIG. 2 and FIG. 5), so that the side bar is released from its engagement with the groove 105 and makes it possible to turn the key plug 102 further in relation to the housing 104. In this way, the lock can be opened by means of the key 200.

Figure 3:
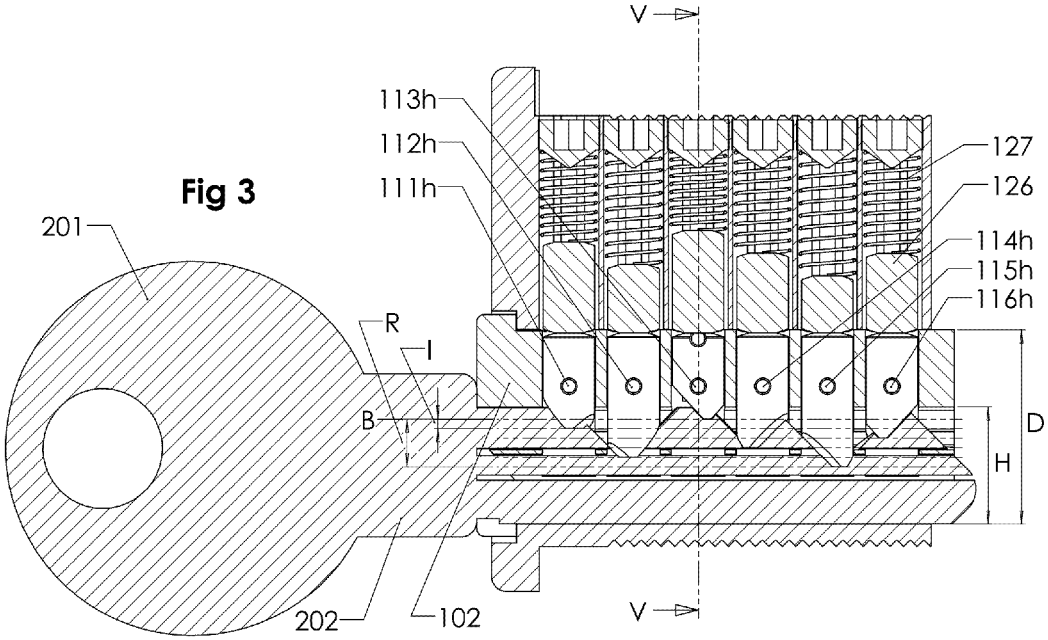
FIG. 3 shows a longitudinal vertical section through the lock and key of FIG. 1.

Each lower tumbler pin 111-116 has a recess or hole 111*h*, 112*h*, 113*h*, 114*h*, 115*h*, 116*h* in its cylindrical outer surface (possibly in the form of a slot extending vertically, i.e. in parallel to the vertical plane P). As will be described further below, each lower tumbler pin can be positioned vertically as well as in its rotational location, by interaction with V-cuts in the upper edge portion of the key blade. These V-cuts 211, 212, 213, 214, 215, 216 (see FIG. 2) each have a certain vertical position as well as a predetermined angular orientation of its bottom portion, so that the tumbler pins 111, 112, 113, 114, 115, 116, with corresponding chisel end portions, will be positioned in predetermined positions, as shown in FIG. 3, where the holes 111*h*, 112*h*, 113*h*, 114*h*, 115*h*, 116*h* are aligned at the same vertical level and are all oriented in a direction pointing in a transversal direction towards the side bar. In this way, these holes or recesses will form accommodating seats for inner projecting lugs 151, 152, 153, 154, 155, 156 on the side bar. Thus, the projecting lugs 151 etc. can be moved into the holes 111*h*, etc. so that the sideward movement of the side bar will not be hindered.

The structure of the cylinder lock and key combination 100,200 described so far is previously known as such, e.g. from the US patent specifications mentioned above, and constitutes a well-functioning and very secure locking device, with the two interacting locking mechanisms involving the tumbler pins 111, etc. and the side bar 150.

However, according to the present invention, the configuration of the side bar 150 and the lower tumbler pins 111-116 is especially adapted in a way that significantly increases the security of the lock and makes it very difficult to manipulate the lock by determining the relative rotational positions of the lower tumbler pins 111-116.

Figure 4:
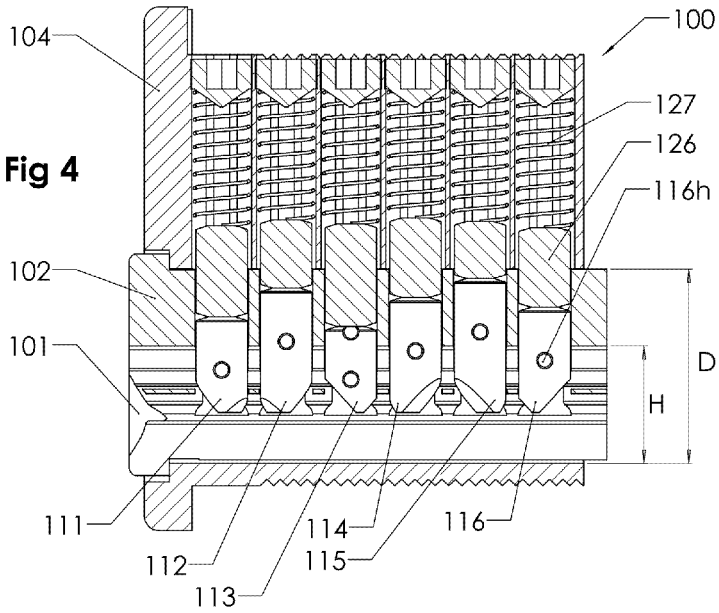
FIG. 4 shows a corresponding vertical section through the lock only, the key being retracted and not shown in this figure.

More particularly, the recesses or holes 111*h*-116*h* are located at a high vertical level in relation to the rotational axis A of the key plug 102, and the holes 111*h*, etc. are also located entirely in the outer cylindrical surface of the respective pin 111, etc., so that the walls of the associated cylindrical holes or recesses 111*a*, 112*a*, 113*a*, 114*a*, 115*a*, 116*a* will cover the respective recess or hole 111*h*, etc. even when the pins are located in the their lowermost positions after retracting the key blade 202 from the keyway 101, and the lock 100 is empty, as shown in FIG. 4. Moreover, the recesses or holes 111*h*, etc. do not communicate with the lowermost, downwardly exposed surface of the tumbler pin. Therefore, even with sophisticated optical or mechanical equipment, it is virtually impossible to determine the relative location of the respective hole 111*h*, etc. It should be noted that, in a typical, normal case of an empty lock 100, the recesses or holes 111*h*, etc. are not oriented in exactly the same way. When retracting the key blade 202, the various V-cuts 211, 212, 213, 214, 215, 216 will cause the lower tumbler pins 111, etc. to rotate somewhat in either direction and the rotational positions will be different from that shown in FIG. 4.

More precisely, the row of inner, projecting lugs 151,152, 153, 154,155,156 is located entirely above the top bitting level of the key blade, i.e. above the uppermost V-cut or bitting 213. The corresponding, shortest lower tumbler pin 113 will thus have its hole 113*h* located entirely above its lower end. So, the hole 113*h* will be completely covered by the cylindrical surface of the associated cylindrical chamber 113*a*, even when the tumbler pin 113 is located in its lowermost position as shown in FIG. 4. It is also important that the recess or hole 113*h* (and also each hole in the other lower tumbler pins 111,112, 114,115,116) does not communicate with any part of the lower end portion being exposed downwardly to the keyway. Accordingly, it will not be possible to identify the relative location of the recess or hole 111*h*, etc. by inspecting the empty keyway 101 by mechanical or optical means.

In order to place the holes 111*h*, etc. at such high levels relative to the keyway and the uppermost bitting levels of the key blade, and also the corresponding projecting lugs 151, 152, 153, 154, 155, 156 at such a high vertical level, the side bar is designed with a large thickness such that the row of inner lugs 151, etc. is located at a higher vertical level than the outer ridge 160 cooperating with the groove 105 in the housing 104. This is most clearly apparent from FIG. 5. It is an advantage to have the outer ridge 160 located at the same vertical level as the rotational axis A of the key plug 102. With such a location, the key plug 102 can be turned in either rotational direction with a smooth interaction between the adjoining oblique guiding surfaces of the ridge 160 and the groove 105, without any undue resistance or blocking action. It is also an advantage to have the sliding direction of the side bar oriented perpendicularly to a vertical plane P through the key plug 102. Accordingly, with these constraints, the side bar must be rather thick in the vertical dimension, as seen in FIG. 5.

Preferably, the thickness t of the side bar 150 is about the same as (or greater than) half of the radius of the key plug 102. In the illustrated example, the thickness t is about 3.4 mm and the radius of the key plug is about 6.5 mm.

Normally, it would be difficult to ensure a smooth and well-functioning guidance of the sliding lateral movement of the side bar 150, but this difficulty is resolved in that the longitudinal end portions 170,180 of the side bar 150 (se FIGS. 6,6*a*,7,7*a*) are provided with laterally extending guiding surfaces 171, 172 and 181,182, respectively. Each pair of such guiding surfaces 171,172 and 181,182 are located opposite to each other at a mutual distance which is smaller than the overall thickness of the side bar. From FIG. 6, it is evident that the respective end portions 170, 180 are fitted into respective end parts of a key plug cavity or recess 106 (see FIG. 5). One of these end parts, namely 106*a*, is visible in FIG. 5, which cooperates and guides the end portion 180 of the side bar 150.

Preferably, the mutual distance of the opposite guiding surfaces 171,172 and 181,182 is about half of the overall vertical thickness or height t of the side bar, or may be even less.

A modified embodiment of the side bar 150' is shown in FIG. 7*b*. It has approximately the same height as the one shown in FIG. 7. However, between each pair of adjacent projecting lugs, here in the form of tongues rather than pins, there are additional upper guiding surface portions 172', 173', 174', 175', 176', in addition to the upper guiding portions 171 and 182. These additional upper guiding surface portions 172', etc. will provide an even smoother guiding of the side bar.

The relatively large thickness t of the side bar 150 (or 150') permits a high positioning of the row of inner projecting lugs 151,152,153,154,155,156. As appears from FIG. 5, the projecting lug 153 (and also each of the other lugs in the row) is located entirely above the uppermost part of the keyway and, as is important according to the invention, also above the top bitting level B of the key being inserted into the keyway (compare FIGS. 5 and 3). This top bitting level B is also located vertically above the level C of the rotational axis A of the key plug 102.

In the example shown in FIGS. 1 through 7 (see especially FIGS. 3 and 5), the diameter D of the rotatable key plug is about 13 mm, and the height H of the key blade 202 is about 8 mm (the height of the keyway being about the same, with just a small play permitting a sliding movement). The top bitting level B is located about 0.8 mm below the level T of the upper edge of the key blade. The increments I between the various bitting levels (six in total) are each 0.64 mm, so the total bitting range R is about 3.2 mm (see FIG. 3). This bitting range R is almost of the same order as the height (or length) of the shortest tumbler pin 103, this height being about 5.5 mm.

The lowest bitting level is located slightly above the level E of the lower ends of the cylindrical chambers 111*a*, etc. accommodating the lower pins 111, etc., so as to guarantee that, in the empty lock as shown in FIG. 4, the lower end portions of all the lower pins 111, etc. are located slightly above a relatively wide lower portion W (FIG. 5) of the keyway. Above this lower portion W, the keyway and the key blade inserted therein, are narrower and forms a relatively narrow keyway portion N, which is also extended in a zig-zag manner upwards to the top end level T (FIG. 5).

As will be seen from FIG. 5, the lower tumbler pin 113 (and the other pins 111,112,114,115,116 as well) is provided with an upper fin 113*b* which projects radially outwardly into an associated cavity 190 having a limited circumferential extension outside the associated cylindrical chamber 113*a*. In this way, the tumbler pin 113 is retained within a limited angular range, which will ensure a well-functioning interaction with the upper edge of the key blade 202 and its coded V-cuts. The underside of each fin may be placed at the same distance from the lower end of the pin, irrespective of the pin length. The vertical thickness may be the same, thus allowing the upper ends of the longer pins to be provided with anti-pick grooves (not shown).

As an optional feature, at least one or some of the fins 113*b* may be extended vertically downwards, as indicated in FIG. 5 by dotted lines for an extended fin 113*b*'. Then, the respective tumbler pin having such an extended fin will be hanging at a slightly higher vertical level, above the lowermost level E of the cylindrical chamber 111*a*, . . . , 116*a*, when the key blade 202 is retracted and the keyway 101 is empty (compare FIG. 4 showing all tumbler pins at the same lowermost positions). The advantage with such an arrangement is that it will make it even more difficult to manipulate the lock.

As stated above, the recesses or holes 111*h*, 112*h*, 113*h*, 114*h*, 115*h*, 116*h* should be located entirely above the top bitting level B, and therefore also above the lowermost end portions of the tumbler pins, so that these recesses or holes 111*h*, etc are open sideways, towards the cylindrical surface of the associated cylindrical chamber 111 *a*, etc. (whereby they will be covered by these cylindrical surfaces) but not downwardly towards the keyway.

Figure 8:
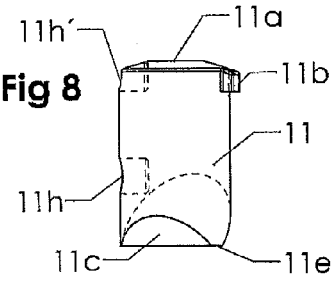
FIG. 8 shows, in a side view, a first embodiment of a tumbler pin included in the cylinder lock of FIG. 5.

In the following, a number of embodiments of the lower tumbler pins will be described with reference to the drawing FIGS. 8 to 20. In all the embodiments, each tumbler pin has a chisel end portion with a lowermost guiding element which will guide the tumbler pin so that it is rotated into an angular position which ensures that a side recess is directed so as to register with one of the projecting lugs of the side bar, after full insertion of a correctly cut key into the keyway of the lock. In FIG. 8, there is shown a first embodiment of a tumbler pin 11 forming a part of the lock according to the invention. The pin 11 is substantially cylindrical, with a top end portion 11*a* having a central, elevated circular contact portion 11*a*, and a fin 11*b* projecting radially outwards from the cylindrical surface adjacent to the upper end. This fin 11*b* is accommodated in a cavity 190 (see FIG. 5) forming a radial extension of the associated chamber 111*a*, 112*a*, 113*a*, 114*a*, 115*a*, 116*a* within a limited angular region that will ensure that the tumbler pin 11 (113 in FIG. 5) will always be oriented within a limited rotational range in the chamber 111*a*, etc. when the key blade 202 is inserted into the keyway 101.

At the lower end portion, the tumbler pin 11 has a chisel configuration, with two inclined planar portions 11*c*, 11*d* (see FIG. 9*b*) having the same inclinational angle and ending on each side of a guiding portion 11*e*, the lower surface of which extends in a horizontal plane that is perpendicular to the vertical axis of the tumbler pin 11. As is previously known per se, one (11*d*) of the inclined planar portions is larger than the other one 11*c*, so that the guiding portion 11*e* is located somewhat offset from the central axis L of the pin 11 (FIG. 8*b*).

Figure 8A:
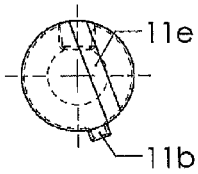
FIGS. 8*a*, 8*b*, 8*c*, 8*d*, 8*e* and 8*f* are views from underneath of the tumbler pin of FIG. 8, in different angular positions and having varying locations of the recesses in the outer cylindrical surface of the pin, the geometrical configuration of the pins shown in FIGS. 8*d*, 8*e*, 8*f* being "mirrored" in relation to the configuration of the pins shown in FIGS. 8*a*, 8*b* and 8*c;*
Figure 8B:
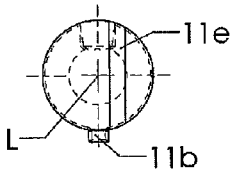
Figure 8C:
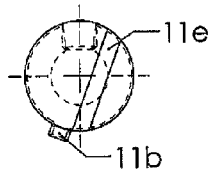
Figure 9A:
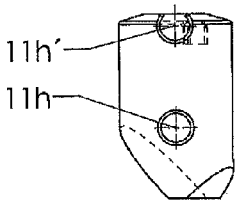
FIGS. 9*a*, 9*b*, 9*c*, 9*d*, 9*e* and 9*f* are corresponding side views of the pins of FIGS. 8*a* through 8*f;*
Figure 9B:
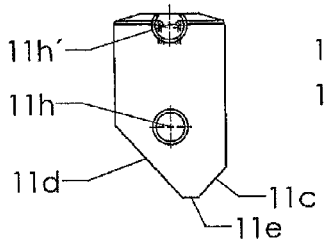
Figure 9C:
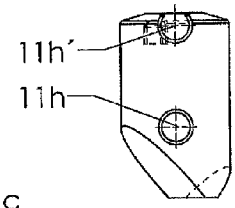
Figure 8D:
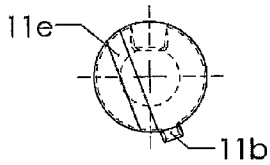
Figure 8E:
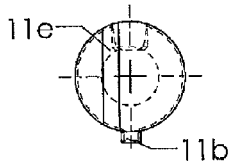
Figure 8F:
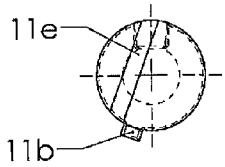
Figure 9D:
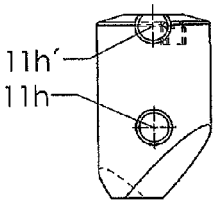
Figure 9E:
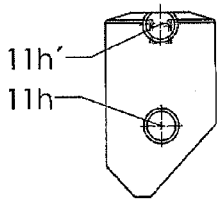
Figure 9F:
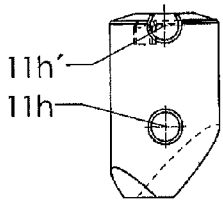

As will be seen from the views from underneath 8*a* through 8*f* and the side views 9*a* through 9*f*, the tumbler pin 11 can be varied into six different modified versions by changing the angular location of the side recess or hole 11*h* in relation to the fin 11*b*, in three different locations, see FIGS. 8*a*, 8*b* and 8*c*, and by placing the fin 11*b* on either side of the guiding portion 11*e*, compare FIGS. 8*b* and 8*e*.

In accordance with the invention, in all these modified versions, each of the holes 11*h* in the cylindrical surface of the tumbler pin is located at a distance from the parts of the lower end portion being exposed downwards towards the keyway.

It also appears from FIGS. 9*a* through 9*f* that there is also a second hole 11 *h*' at the same angular position, but located very close to the upper end. This makes it possible to provide further codes or a master key system, as is known per se in this technological field. A further development to provide a master key system would be to add another hole 11*h* located at a different vertical level and/or at a different angular position.

Figure 10:
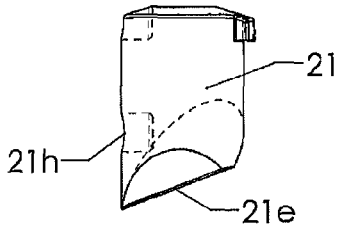
FIG. 10 shows, in a side view, a second embodiment of a tumbler pin having an inclined lower guiding portion.
Figure 10A:
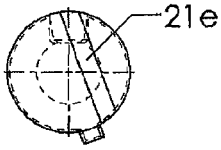
FIGS. 10*a*, 10*b*, 10*c*, 10*d*, 10*e*, and 10*f* are views from underneath (corresponding to FIGS. 8*a* through 8*f*) of the pin of FIG. 10, with various locations of the side recesses.
Figure 10B:
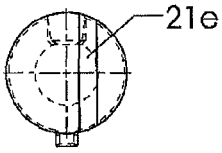
Figure 10C:
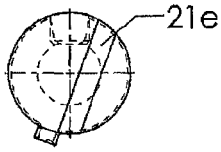
Figure 11A:
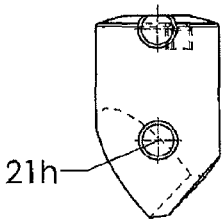
FIGS. 11*a*, 11*b*, 11*c*, 11*d*, 11*e*, and 11*f* are corresponding side views of the pins of FIGS. 10*a* through 10*f;*
Figure 11B:
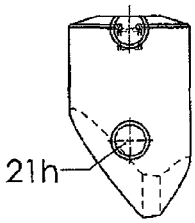
Figure 11C:
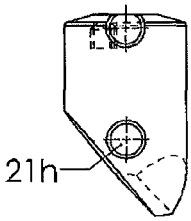
Figure 10D:
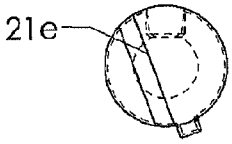
Figure 10E:
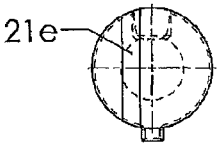
Figure 10F:
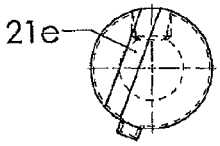
Figure 11D:
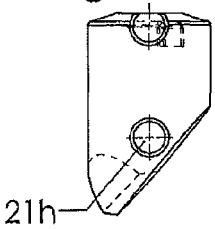
Figure 11E:
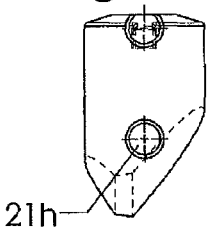
Figure 11F:
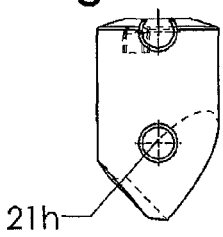
Figure 12:
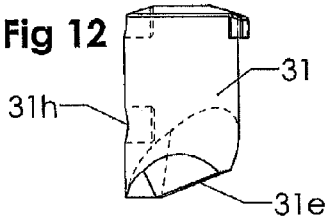
FIG. 12 shows, in a side view, a third embodiment of a tumbler pin being similar to the second embodiment and having a lower guiding portion which is inclined only along a limited portion of the lower end.
Figure 12A:
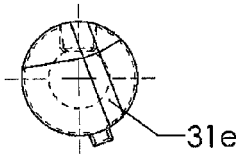
FIGS. 12*a*, 12*b*, 12*c*, 12*d*, 12*e*, and 12*f* are views from underneath (corresponding to FIGS. 8*a* through 8*f*) of the pin of FIG. 12, with various locations of the side recesses.
Figure 12B:
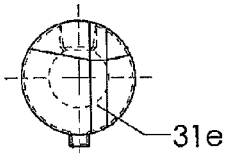
Figure 12C:
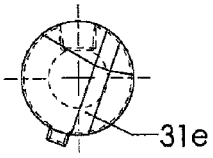
Figure 13A:
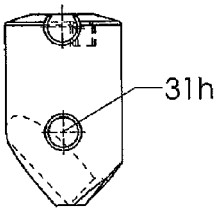
FIGS. 13*a*, 13*b*, 13*c*, 13*d*, 13*e*, and 13*f* are corresponding side views of the pins of FIGS. 12*a* through 12*f.*
Figure 13B:
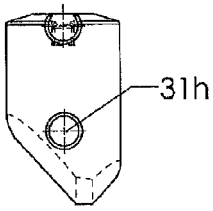
Figure 13C:
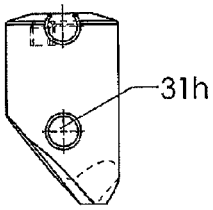
Figure 12D:
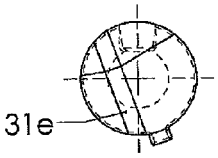
Figure 12E:
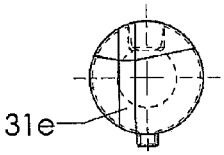
Figure 12F:
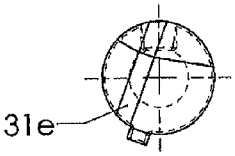
Figure 13D:
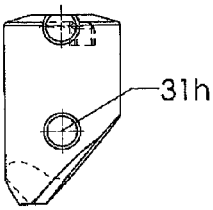
Figure 13E:
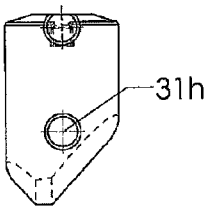
Figure 13F:
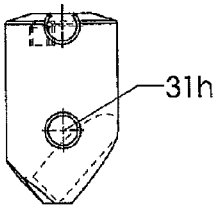

A second embodiment of the tumbler pin, denoted 21, is shown in FIGS. 10, 10*a* through 10*f*, and 11*a* through 11*f*, the difference to the tumbler pin 11 in FIG. 8 being that the lower guiding portion 21*e* is inclined so as to rise from left to right in FIG. 10. This will affect the geometrical shape of the V-cut bittings of the key blade, but the various locations of the holes 21*h* are the same as for the first embodiment (compare the FIGS. 9*a* through 9*f* and FIGS. 11*a* through 11*f*). Also, of course, the inclination of the guiding portion 21*e* may be reversed, i.e. the guiding portion may rise from right to left in FIG. 10 (for a slightly longer pin). So, the inclination may also be used for master keying. Thus, a master key may have a bitting with two inclined portions corresponding to two different locks.

A still further, third embodiment of the tumbler pin, denoted 31, is shown in FIGS. 12, 12*a* through 12*f*, and 13*a* through 13*f*. Again, the various locations of the holes 31*h* are the same as in the first embodiment, but the lower end portion of the pin 31 is slightly different, with a lower guiding portion 31*e* which is inclined only along a limited portion of the lower end. Of course, the key blade V-cut bittings have to be adjusted accordingly.

A fourth embodiment is shown in FIGS. 14, 14*a* through 14*f*, and 15*a* through 15*f*, where the tumbler pin 41 has a lower end with a part-cylindrical, skirt-like portion 41*f* and a chisel portion 41*f*' with a guiding portion 41*e*' extending along a part of the lowermost, horizontal end surface. In this case, the V-cut bittings of the key blade have to be adapted so as to accommodate the pin 41 with its special lower end portion. Again, the locations of the holes 41*h* may be varied in the same way as in the first embodiment (FIGS. 8 and 9*a* through 9*f*).

In FIGS. 16*a* through 16*e* and 17*a* through 17*e*, three different kinds of recesses in the cylindrical surface portion of the tumbler pin are shown.

Figure 16A:
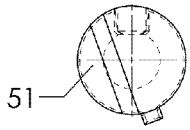
FIGS. 16*a*, 16*b*, 16*c*, 16*d*, 16*e* and 17*a*, 17*b*, 17*c*, 17*d*, 17*e* illustrate (in views from underneath and side views, respectively) similar tumbler pins having three different kinds of side recesses in the outer cylindrical portion of the pin, the continuous recesses in the form of grooves in FIGS. 17*d* and 17*e* being extended almost to the lowermost end of the pin.
Figure 17A:
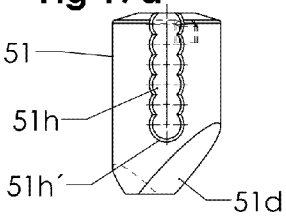

In FIGS. 16*a* and 17*a*, the recess 51*h* in the outer cylindrical surface of the tumbler pin 51 is formed by a number of mutually adjacent radial bores. The lowermost bore 51*h*' is located at a distance from the inclined chisel surface 51*d*. Accordingly, the lower pin surface portions being exposed downwards towards the keyway 101 are unaffected by the bores forming the recess 51*h*. Therefore, it is not possible to identify the angular location of the recess 51*h*.

Figure 14:
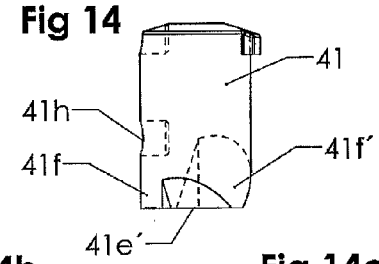
FIG. 14 shows, in a side view, a fourth embodiment of a tumbler pin, having a lower end with a part-cylindrical portion and an adjoining chisel portion.
Figure 14A:
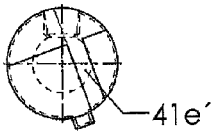
FIGS. 14*a*, 14*b*, 14*c*, 14*d*, 14*e*, and 14*f* are views from underneath the pin of FIG. 14, corresponding to those of FIGS. 8*a* through 8*f*, with various locations of the side recesses.
Figure 14B:
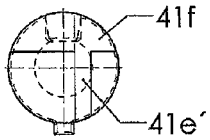
Figure 14C:
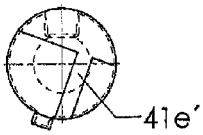
Figure 15A:
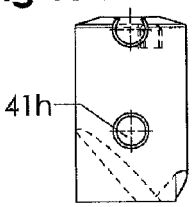
FIGS. 15*a*, 15*b*, 15*c*, 15*d*, 15*e*, and 15*f* are corresponding side views of the pins of FIGS. 14*a* through 14*f;*
Figure 15B:
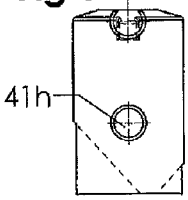
Figure 15C:
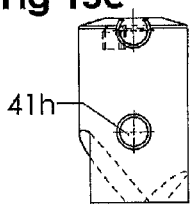
Figure 16B:
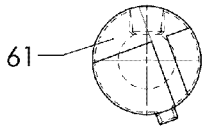
Figure 17B:
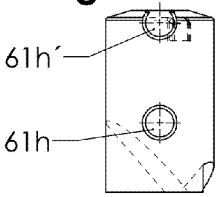

In FIGS. 16*b* and 17*b*, the holes 61*h* and 61*h*' in the pin 61 are individual and separate bores just like the ones in the fourth embodiment shown in FIGS. 14*a* and 15*a*.

Figure 14D:
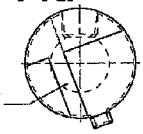
Figure 14E:
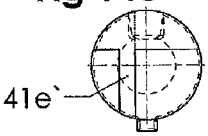
Figure 14F:
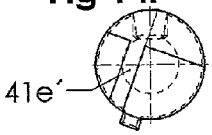
Figure 15D:
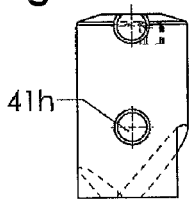
Figure 15E:
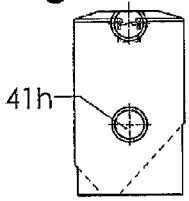
Figure 15F:
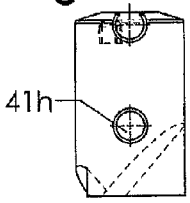
Figure 16C:
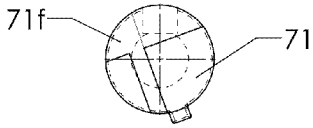
Figure 17C:
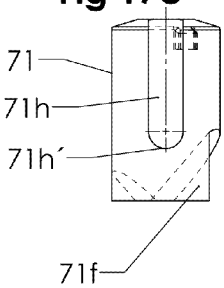
Figure 16D:
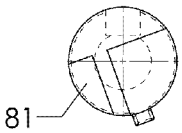
Figure 16E:
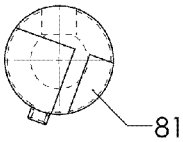
Figure 17D:
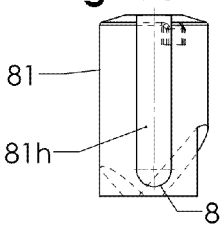
Figure 17E:
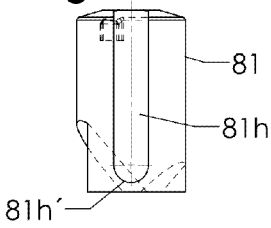

As a third example, the recess 71*h* in the pin 71 (the embodiment of the pin being identical to the one shown in FIGS. 14*d* and 15*d*) shown in FIGS. 16*c* and 17*c* is a continuous slot ending at a point 71*h*' located at some distance from the lowermost end of the part-cylindrical skirt portion 71*f*. Because of the this skirt portion, it is possible to extend the slot further downwards, as shown in FIGS. 16*d*, 17*d* and 16*e*, 17*e* for two different angular positions of the elongated recess 81*h* which ends at a point 81*h*' very close to the lower end surface of the pin. Still, the recess 81*h* will be concealed and will not be visible from underneath when mounted in the lock. As in the other embodiments, there are further possibilities to locate the elongated recess 81*h* at a number of different positions in the circumferential or angular direction.

Figure 18:
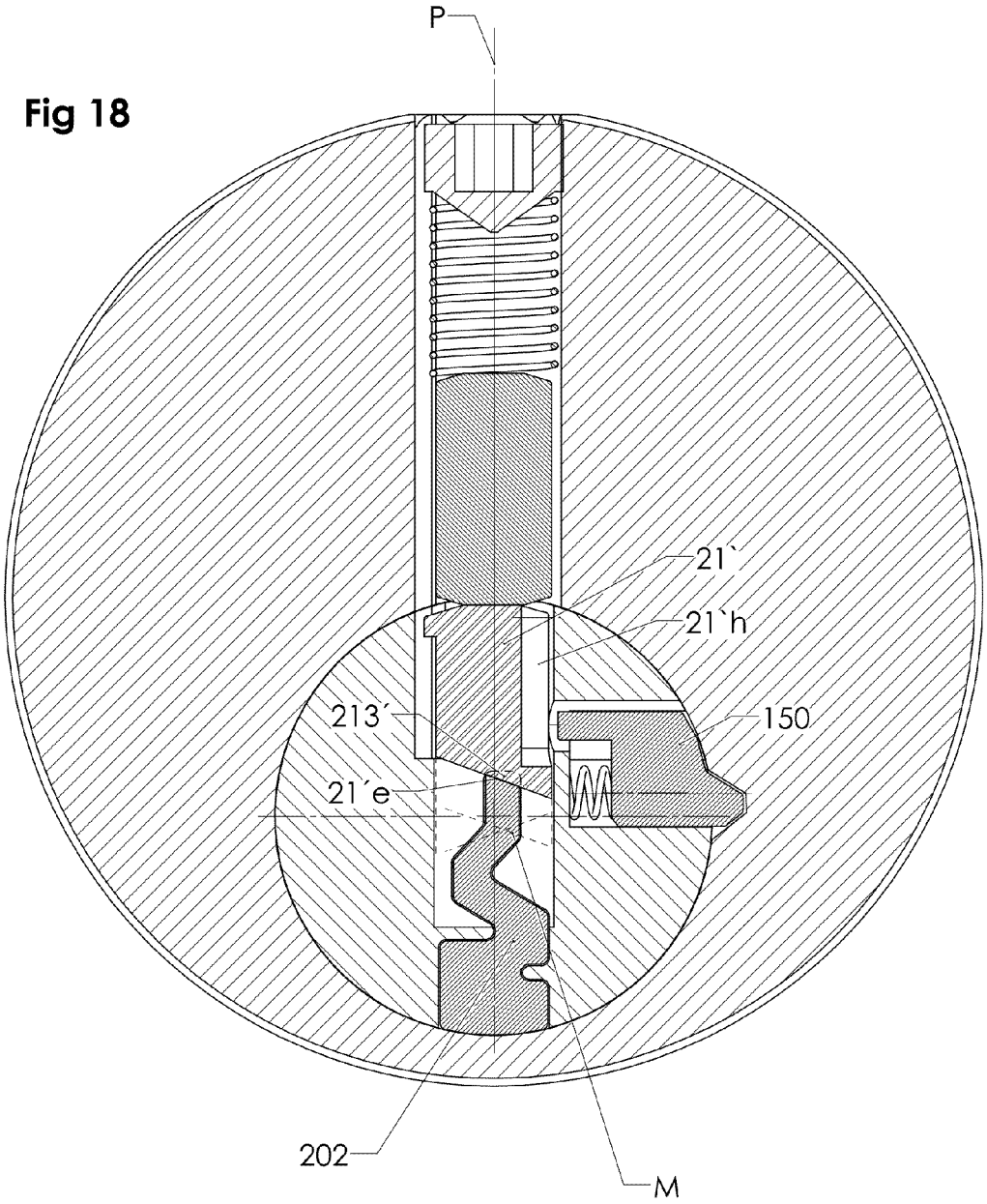
FIG. 18 shows a cross-section through the key plug of the lock with an inserted key blade, similar to FIG. 5, illustrating a further embodiment of the tumbler pins.

In FIG. 18, there is shown a cross-section, corresponding to FIG. 5, of an embodiment with a lower tumbler pin 21' similar to the one (21) shown in FIG. 10, but having an elongated side recess 21'*h* in its cylindrical outer surface. Here, the coded V-cut forming the bitting 213' of the key blade 202 is inclined, relative to a horizontal plane being perpendicular to a central axis of the tumbler pin (the central axis being located in a central plane P through the keyway and the inserted key blade 202), with the same inclinational angle as the bottom guiding portion 21*e*' of the tumbler pin. This will ensure a well-functioning linear contact between the V-cut and the tumbler pin.

If the pin 21' is slightly longer, it can have its inclinational angle of the guiding portion 21*e*' reversed, i.e. rising from left to right instead of from right to left, as indicated in FIG. 18 with dotted lines. These dotted lines correspond to two different pins of two different locks. By forming the V-cut with corresponding V-cut portions, having opposite inclinational angles, meeting each other at a mid-point M, a master key is obtained. This master key can operate the two different locks.

FIG. 19 shows a further embodiment, in a cross-section similar to the one in FIG. 18, with a tumbler pin 41' of the same kind as in FIG. 14, i.e. a tumbler pin having a skirt portion reaching all the way down to the end surface of the pin. In this skirt portion, there is an elongated recess 41'*h* in the outer cylindrical surface, which cooperates with a projecting lug 153' on the side bar 150'. The projecting lug 153' has a larger height than in the previous embodiments, the lug being formed like a tongue, rather than a cylindrical pin, as on the modified side bar 150' of FIG. 7*b*.

Here, the recess 41'*h* reaches very far down to a point very close to the bottom surface of the pin. The chisel portion of the pin, with two inclined, flat surface portions 41'*c* and 41'*d* (see FIG. 20*a*) are located at an opposite side of the pin, to the left in FIG. 19. Also, the upper, narrow part N of the key blade 202' is offset (to the left in FIG. 19) in relation to the central plane P, leaving about half of the associated cylindrical chamber 113'*a* empty, at the right hand side of the keyway.

In this embodiment, the tumbler pin 41' is optionally provided with an extra recess 41'*h*', which is illustrated in FIGS. 20, 20*b*, and 20*d*. The extra recess is not as deep as the "real" recess 41'*h* and is actually a "false" recess intended to make it even more difficult for those who try to manipulate and open the lock, without a correctly cut key. Thus, if the projecting lug or tongue 153' finds it way into the extra or false recess 41'*h*', the side bar 150' will get stuck in a position where it does not release the ridge portion 160' from its associated groove in the housing 104. Of course, such extra or false recesses may be provided even for all other embodiments described above.

It will be apparent from FIG. 19 that it is very difficult to identify or reach the side recess 41'*h* when the keyway is located at an opposite side in relation to the location of the side bar 150' and the side recess 41'*h*.

It will be understood that the various embodiments of the pins and their recesses shown in FIGS. 8, 10, 12, 14, 16*a* through 17*e*, 18,19 and 20 will all satisfy the criteria set up according to the present invention, namely to be completely concealed by the associated cylindrical chamber in the key plug and to have no communication at all with the lower end surface portions of the pin being exposed downwardly towards the keyway.

The invention also relates to a side bar, as described above and defined specifically in the claims, a special key having a chisel end portion being inclined from one side of the key to the other, as well as a key blank with an offset, relatively narrow upper part of the key blade.

The lock and key combination according to the invention may be modified in various ways within the scope of the claims. One modification would be that there is another locking mechanism, in addition to the one described above. An example of such a locking mechanism is a code pattern at one or two sides of the key blade, cooperating with side locking tumblers in the key plug, e.g. as disclosed in the U.S. Pat. Nos. 5,715,717, 7,159,424, 7,665,337, and 8,448,485 (all in the name of Widén). Another modification would be to have pins with two tips fitting fully into some, but not necessarily all adjacent bittings in the key blade, as disclosed in the U.S. Pat. No. 7,958,760 (Widén).

The invention claimed is:

1. A cylinder lock and key combination, including a cylinder lock (100), comprising:

a housing (104) having a cylindrical bore (103) accommodating a rotatable key plug (102), said key plug (102) having a longitudinally extending keyway (101) for receiving a key blade (202), a row of tumbler pins (111, . . . , 116) arranged for elevational and rotational movement in corresponding cylindrical chambers (111*a*, . . . , 116*a*) in said key plug (102) for engagement with coded V-cut bittings (211, . . . , 216) on an upper edge of an associated key upon insertion thereof into said keyway (101), and a longitudinal side bar (150) which is slidingly journalled for transversal movement in said key plug (102), said side bar having an outer, longitudinal ridge portion (160) fitting into an associated groove (105) in said housing, so as to normally prevent rotation of said key plug (102) in said cylindrical bore of the housing, said side bar (150) also having a row of inner projecting lugs (151, . . . , 156) each selectively registering with one or more recesses (111*h*, . . . , 116*h*) in said tumbler pins when said key has been inserted into the keyway (101), said side bar (150) being movable sideways by turning of a correctly cut key, while said projecting lugs enter into an one of associated tumbler pin recesses so that said longitudinal ridge portion (160) is released from said groove and the key plug (102) is permitted to rotate relative to said housing (104), and a key (200), comprising said key blade (202) having:

an upper edge provided with said coded V-cut bittings (211, . . . , 216), wherein:

each of the lugs in said row of inner projecting lugs (151, . . . , 156) of said side bar (150) is located at a relatively high level, above a rotary axis (A) of the key plug (102), when being moved sideways with the side bar (150) into the respective tumbler pin recesses (111*h*, . . . , 116*h*), whereas the outer longitudinal ridge portion (160) of the side bar (150) is located at a substantially lower vertical level than the inner projecting lugs (151, . . . , 156), namely at substantially a same vertical level as the rotary axis (A) of the key plug (102), seen in a central vertical plane (P) in the keyway (101), when the outer longitudinal ridge portion (160) engages with the associated groove (105) in the housing (104), and said tumbler pins (111, . . . , 116) are configured so that each of said pin recesses (111*h*, . . . , 116*h*) is located entirely above the rotary axis (A) of the key plug (102) and also entirely above a lowermost end portion of the tumbler pin (111, . . . , 116) in a cylindrical outer surface of the tumbler pin and is covered by a cylindrical wall part of an associated one of said cylindrical chambers (111*a*, . . . , 116*a*), without communicating downwardly with the keyway (101), whereby each pin recess is concealed and invisible from an inside of said keyway, even when the keyway (101) is empty.

2. The cylinder lock and key combination as defined in claim 1, wherein each of inner projecting lugs (151, . . . , 156) in the row is located above the keyway (101).

3. The cylinder lock and key combination as defined in claim 1, wherein when the key blade (200) is inserted into the keyway (101), the key blade (200) has a top bitting level (B) located above the rotary axis (A) of the key blade (200), and each of the inner projecting lugs (151, . . . , 156) in the row of the inner projecting lugs (151, . . . , 156) is located above the top bitting level (B) of the key blade (200).

4. The cylinder lock and key combination as defined in claim 1, wherein said side bar (150), at each longitudinal end portion (170, 180) thereof, has transversally extending guiding surfaces (171, 172, 181, 182) which secure a precise lateral guiding of the side bar (150) in said key plug.

5. The cylinder lock and key combination as defined in claim 4, wherein said transversally extending guiding surfaces (171, 172, 181, 182) are located opposite to each other at a mutual distance which is smaller than an overall thickness (t) of the side bar (150).

6. The cylinder lock and key combination as defined in claim 1, wherein said side bar (150') has transversally extending upper guiding surfaces (172', etc.) between at least some of said inner projecting lugs (151', etc.), and a mutual distance between the upper guiding surfaces (172', etc.) and opposite lower guiding surfaces (172, 182) being smaller than an overall thickness (t) of the side bar (150).

7. The cylinder lock and key combination as defined in claim 1, wherein at least some of the tumbler pins (11) have pin recesses (11*h*, 11*h*') located at at least two different locations, so as to enable forming of a master key system, said different locations being at least one of different vertical levels and different circumferential locations.

8. The cylinder lock and key combination as defined in claim 1, wherein all of said cylindrical chambers (111*a*, . . . , 116*a*) reach down to a same vertical level (E), below which said keyway (101), is wider than an upper part of said keyway (101), corresponding to a lower, relatively wide part (W) of the key blade (202) of said key (200), and wherein the V-cut code bittings (211, . . . , 216) are all located in an upper, relatively narrow part (N) of said key blade (202).

9. The cylinder lock and key combination as defined in claim 8, wherein said narrow part (N) of said key blade (202') is offset in relation to a central vertical plane (P) through said keyway and said key blade (202') upon insertion of the key blade into the keyway.

10. The cylinder lock and key combination as defined in claim 1, wherein each of said tumbler pins (11) has a lower portion with two oppositely located inclined planar surface portions (11*c*, 11*d*) forming between them a linear, relatively narrow guiding portion (11*e*) fitting into a corresponding one of the coded V-cut bittings (B), and wherein each pin recess (11*h*) is located at a cylindrical outer surface portion at a distance from any of said inclined surface portions.

11. The cylinder lock and key combination as defined in claim 10, wherein said two oppositely located inclined planar surfaces portions (11*c*, 11*d*) have a same inclinational angle, and wherein said relatively narrow guiding portion (11*e*) is offset from a central axis (L) of the tumbler pin (11).

12. The cylinder lock and key combination as defined in claim 10, wherein said two oppositely located inclined planar surface portions occupy only a part of a circumference of the tumbler pin (41), leaving a massive, part-cylindrical skirt portion (41*f*) at a lower end of the pin, said skirt portion ending at substantially a same vertical level as said relatively narrow guiding portion (41*e*').

13. The cylinder lock and key combination as defined in claim 12, wherein said pin recess (41*h*, 81*h*) on at least one of the tumbler pins is located at an outer cylindrical surface of said skirt portion, without communicating with a lowermost end surface or any of the two oppositely located inclined planar surface portions, whereby said pin recess (81*h*) may be located relatively close (81*h*') to the lowermost end of the tumbler pin, without being visible from an inside of a key slot, and enabling a shortest one of the tumbler pins to have a relatively short length which is only slightly longer than a vertical bitting range (R) of the key blade (202).

14. The cylinder lock and key combination as defined in claim 10, wherein said relatively narrow guiding portion (21*e*) is inclined at an angle relative to a horizontal plane which is perpendicular to a longitudinal axis of the tumbler pin (21).

15. The cylinder lock and key combination as defined in claim 14, wherein said V-cut bittings (211', . . . , 216') on the key blade are also inclined at said angle relative to said horizontal plane, so as to provide a linear contact with said guiding portions (21*e*) of the associated pins (21).

16. The cylinder lock and key combination as defined in claim 1, wherein each of said tumbler pins (111, . . . , 116) is provided with a guiding fin (113*b*) projecting radially outwardly and being accommodated in a cavity (190), which forms a radial extension of an associated chamber (113*a*) within a limited angular region, whereby the tumbler pins (111, . . . , 116) are always adapted to be oriented within a limited rotational range in said associated chamber.

17. The cylinder lock and key combination as defined in claim 16, wherein said radial fins (113*b*) have different vertical lengths, in parallel to a vertical axis of the associated pin (113), so that the tumbler pins (111, . . . , 116) are adapted to be urged downwards with lower ends thereof, and are adapted to be located at different vertical levels when the key blade (202) is retracted from the keyway (101).

18. The cylinder lock and key combination as defined in claim 1, wherein the outer cylindrical surface of at least one of said tumbler pins (41') is provided with an extra recess (41'*h*') which is deliberately configured or located so as to retain the pin (41') and/or the side bar (150'), when the associated projecting lug (151, . . . , 156) is seated in said extra recess, in a position which does not permit rotation of the key plug (102) relative to the housing (104) of the lock (100).

19. A side bar for a cylinder lock having a key plug (102) which is rotatable in a housing (104), the side bar (150) being slidable sideways in the key plug (102) and having an outer ridge portion (160) which is normally seated in a groove (105) in the housing, and inner projecting lugs (151, . . . , 156) dimensioned to be seated in associated recesses (111*h*, . . . , 116*h*) in tumbler pins, which are movable in said key plug, wherein:

said projecting lugs (151, . . . , 156) are located at a substantially higher level than said outer ridge portion (160) of the side bar (150) and said axis (A) of said key plug (102), and the side bar (150) is guided by means of opposite guiding surfaces (171, 172, 181, 182, 172', . . . 176') located at a mutual distance being substantially smaller than an overall thickness (t) of the side bar (150).

20. The side bar as defined in claim 19, wherein the overall thickness (t) of the side bar (150) is at least as large as half of a radius (D/2) of said key plug (102).

21. A key (200) for a lock (100), comprising:

a key blade (202) having a single upper edge with V-cut bittings (213, . . . ), each V-cut bittings (213, . . . ) standing at a respective one of a first number of angles relative to a transverse vertical plane, each being perpendicular to a longitudinal direction of the key blade (202), and each being located at a respective one of a second number of vertical levels in relation to an opposite lower edge of the key blade (202), wherein the V-cut bittings (213, . . . ) at the upper edge of the key blade (202) are irregularly arranged in two ways:

a linear bottom portion of at least some V-cut bittings (213, . . . , 216, is displaced in the longitudinal direction of the key blade (202) in relation to a vertical plane extending transversely and centrally through a position corresponding to the central axis of an associated one (21) of tumbler pins (111 . . . ) of the lock when the key (200) is fully inserted into the lock (100), the linear bottom portion of the at least some V-cut bittings (213, . . . ) is inclined in relation to a horizontal plane extending along the key blade (202), so that the at least some V-cut bittings (213, . . . , 216) are is deeper at one side of the key blade (202) than at another side of the key blade (202), wherein the horizontal plane extending along the key blade (202) is normal to central axes of the associated tumbler pins of the lock (100) when the key is fully inserted into the lock, and the at least some V-cut bittings (213, . . . ) of the key blade (202) are configured to cooperate with the associated tumbler pins (111 . . . ), and wherein each of the tumbler pins (111 . . . ) includes:

a projecting V-formed end portion having a shape that is substantially complementary to the associated V-cut bittings, and a lowermost edge portion (21*e*) that is generally offset in the longitudinal direction of a keyway in relation to a central, longitudinal axis of the tumbler pins (111 . . . ), so that the lowermost edge portion (21*e*) is also inclined in relation to a plane that is perpendicular to the central, longitudinal axis of the tumbler pins 111 . . . ).

22. A key as defined in claim 21, wherein the linear bottom portion of at least one of the V-cut bittings (213, . . . ) is inclined upwardly from one side of the key blade (202) to an opposite side at a first part of a thickness of the key blade (202), and is inclined downwardly at a second part of the thickness of the key blade (202), so that the at least one of the V-cut bittings (213, . . . ) is deeper at the one side of the key blade (202) than at the opposite side of the key blade (202).

23. A key blank with an elongated key blade having a lower, relatively wide part (W) and an upper, relatively narrow part (N) intended to be provided with a number of bittings, wherein said relatively narrow part (N) of said key blade (202) is offset in relation to a central vertical plane (P) through said lower, relatively wide part (W), and wherein there is an inclined transition region of the key blank, extending obliquely upwards from one side of said relatively wide part (W) to a position above the other side of said relatively wide part (W).

24. The cylinder lock and key combination as defined in claim 1, wherein the side bar (150) has an overall thickness (t), measured in a vertical direction in parallel to the central vertical plane (P), which is at least half of a radius of the cylindrical bore (103).

25. The cylinder lock and key combination as defined in claim 1, wherein each of the V-cut bitting (211, . . . , 216) in the upper edge of the key blade (202) of the key (200) stands at respective one of a first number of angles relative to a transverse direction, and is located at a respective one of a second number of vertical levels in relation to an opposite lower edge of the key blade (202).

26. A key as defined in claim 21, wherein the linear bottom portion of the at least one of the V-cut bittings (213, . . . ) includes:

a first portion that is inclined in relation to the horizontal plane, and a second portion that is parallel to said horizontal plane, so that the at least one of the V-cut bittings (213, . . . ) is deeper at the one side of the key blade than at the second side of the key blade (202).

27. A key as defined in claim 21, wherein at least one of the tumbler pins (111, . . . ) having the V-formed end portion includes a lowermost edge portion that is at least partially inclined in relation to the plane that is perpendicular to the central, longitudinal axis of the tumbler pin (21), and the key (200) has an upper single edge portion on each of the V-cut bittings (213, . . . ) having two opposite sloping surfaces which merge at the linear bottom portion, and each of the V-cut bittings (213, . . . ) stands at a respective one of the first number of angles relative to the transverse vertical plane, that is perpendicular to the longitudinal direction of the key blade, and each of the V-cut bittings (213, . . . ) is located at a respective one of the second number of vertical levels in relation to an opposite lower edge of the key blade (202), wherein the linear bottom portion of the at least one of the V-cut bittings (213, . . . ) is inclined in relation to the horizontal plane extending along the key blade (202), so that the at least one of the V-cut bittings (213, . . . ) is deeper at the one side of the key blade (202) than at the opposite side of the key blade (202), and the V-formed end portion of the at least one of the tumbler pins (111, . . . ) and the associated one of the V-cut bittings (213, . . . ) of the key blade (202) have substantially complementary geometrical configurations, whereby the at least one of the tumbler pins (111, . . . ) is elevated and rotated into a predetermined position upon fully inserting the key (200) into the lock (100).

* * * * *